US007784652B2

(12) United States Patent
Gaus et al.

(10) Patent No.: US 7,784,652 B2
(45) Date of Patent: Aug. 31, 2010

(54) DISPENSING VALVE WITH HYDRAULIC HAMMER RESISTANCE

(75) Inventors: David J. Gaus, Saginaw, MI (US); Gregory M. Olechowski, Rhodes, MI (US); Mark R. Honard, Saginaw, MI (US)

(73) Assignee: Liquid Molding Systems, Inc., Midland, MI (US)

( * ) Notice: Subject to any disclaimer, the term of this patent is extended or adjusted under 35 U.S.C. 154(b) by 658 days.

(21) Appl. No.: 11/728,614

(22) Filed: Mar. 27, 2007

(65) Prior Publication Data

US 2008/0237278 A1 Oct. 2, 2008

(51) Int. Cl.
*B65D 47/20* (2006.01)

(52) U.S. Cl. ..... 222/494; 222/212; 222/490

(58) Field of Classification Search ..... 222/212, 222/490, 494; 137/845, 849
See application file for complete search history.

(56) References Cited

U.S. PATENT DOCUMENTS

| | | | | |
|---|---|---|---|---|
| 4,991,745 | A | 2/1991 | Brown | |
| 5,115,950 | A | 5/1992 | Rohr | |
| 5,271,531 | A | 12/1993 | Rohr et al. | |
| 5,409,144 | A | 4/1995 | Brown | |
| 5,531,363 | A * | 7/1996 | Gross et al. | 222/494 |
| 5,676,289 | A | 10/1997 | Gross et al. | |
| 5,904,275 | A | 5/1999 | Suffa | |
| 6,062,435 | A | 5/2000 | Hess, III | |
| 6,112,952 | A | 9/2000 | Hess, III et al. | |
| 6,273,296 | B1 | 8/2001 | Brown | |
| 6,405,901 | B1 | 6/2002 | Schantz et al. | |
| 6,427,874 | B2 | 8/2002 | Brown et al. | |
| 6,530,504 | B2 | 3/2003 | Socier | |
| 2002/0158083 | A1 * | 10/2002 | Brown et al. | 222/212 |
| 2008/0035677 | A1 | 2/2008 | Daansen | |

FOREIGN PATENT DOCUMENTS

| | | |
|---|---|---|
| FR | 996 998 | 12/1951 |
| WO | WO 98/14386 | 4/1998 |
| WO | WO 99/10247 | 3/1999 |

OTHER PUBLICATIONS

U.S. Appl. No. 10/695,227 and its divisional filed Dec. 6, 2006.

* cited by examiner

*Primary Examiner*—Kenneth Bomberg
(74) *Attorney, Agent, or Firm*—Wood, Phillips, Katz, Clark & Mortimer

(57) ABSTRACT

A fluid dispensing valve is provided with a peripheral mounting portion and a connecting sleeve connecting the peripheral mounting portion with a head which defines a dispensing orifice. The valve head includes a central inner surface portion that bulges axially inwardly to project from a radially outer surface portion.

18 Claims, 13 Drawing Sheets

FIG. 9
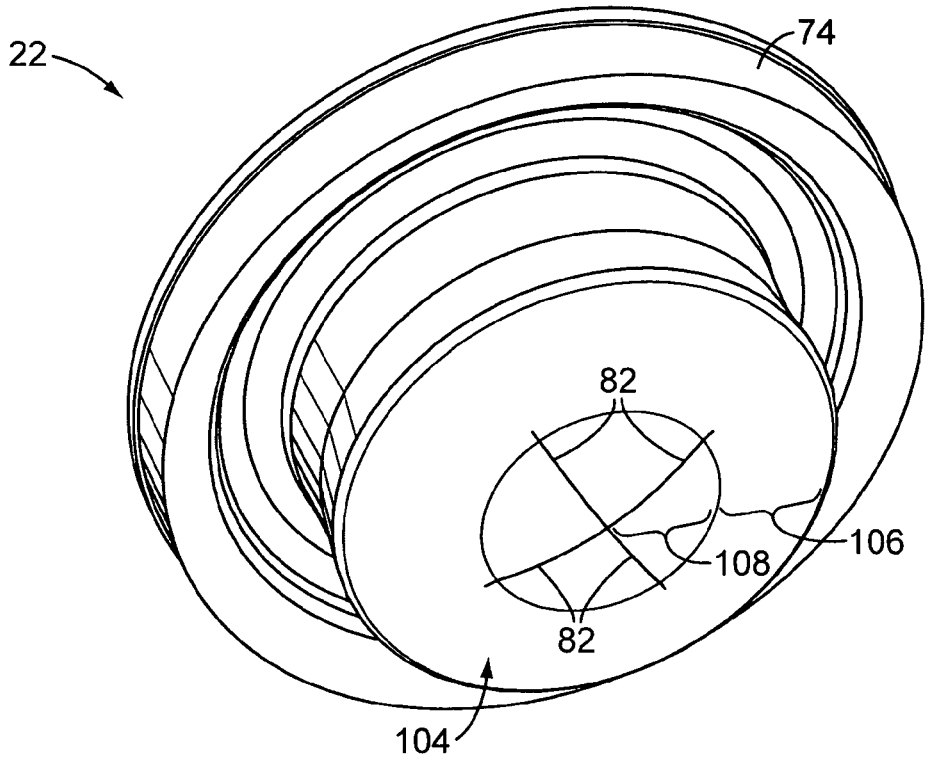
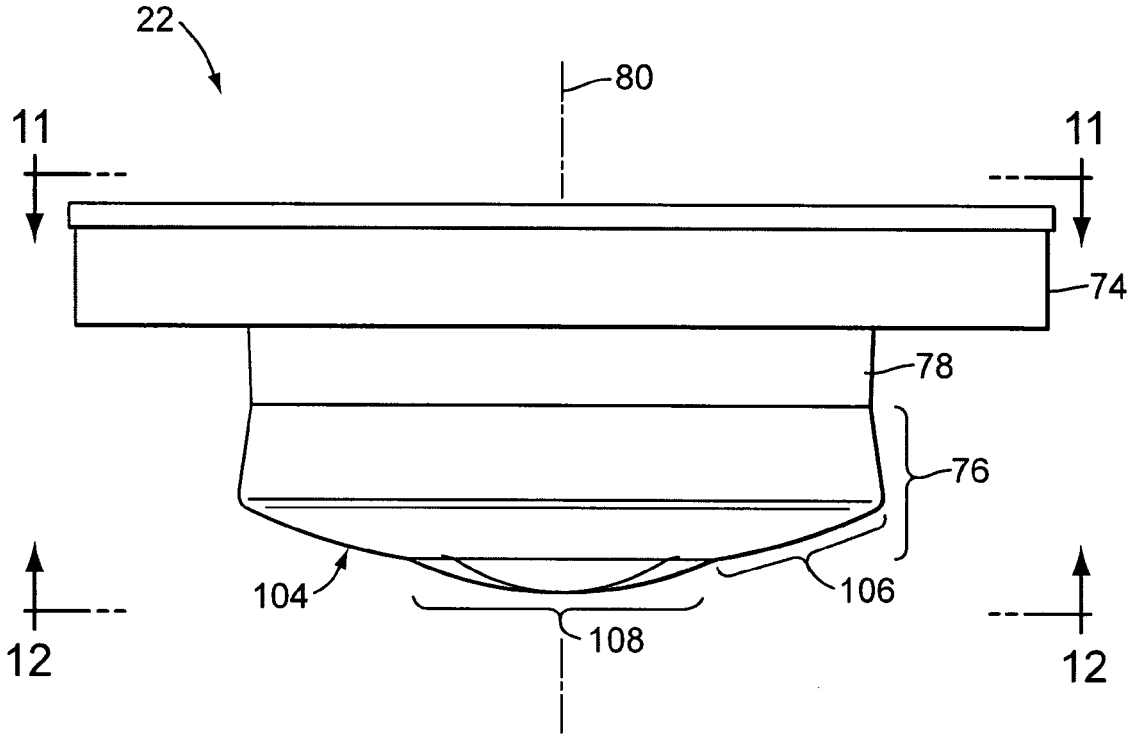
FIG. 10

FIG. 16
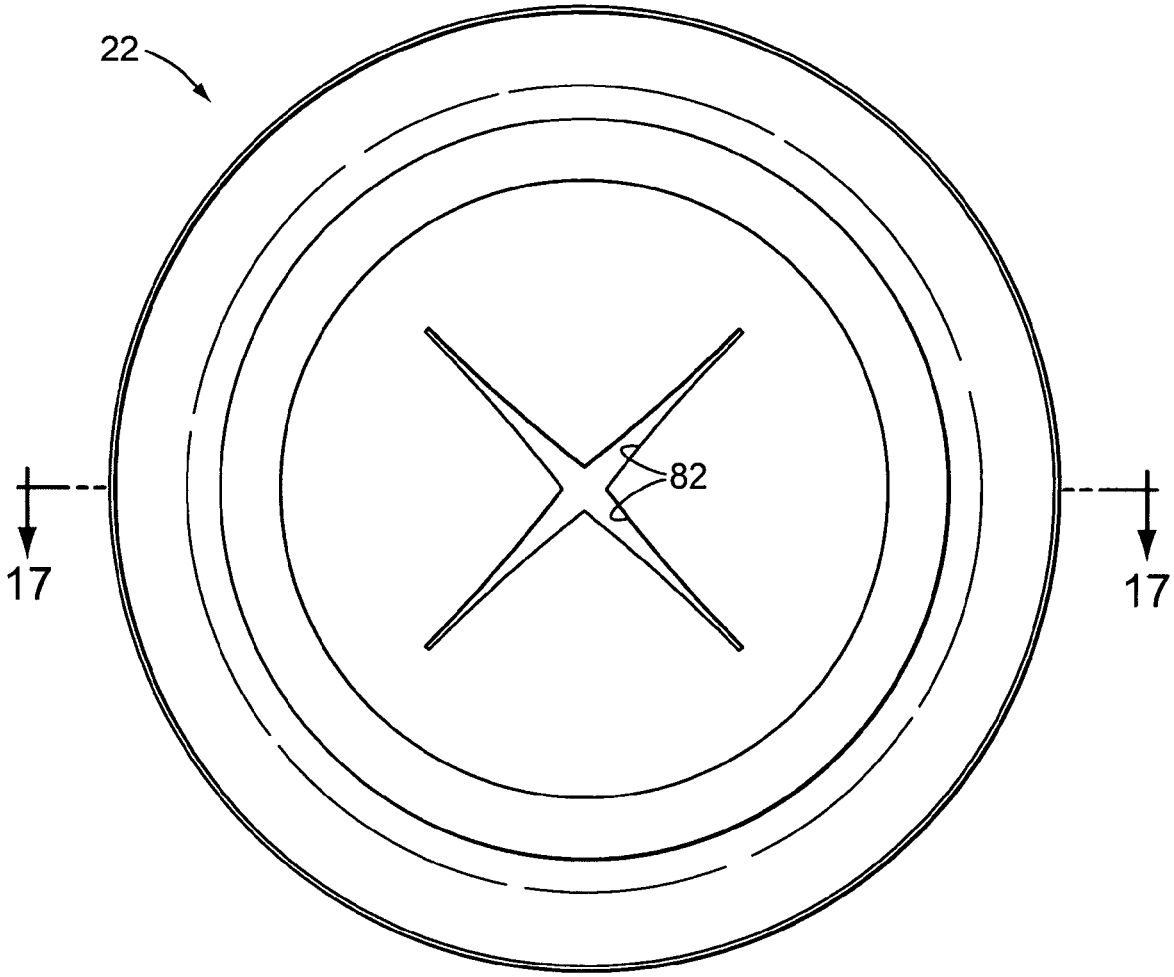
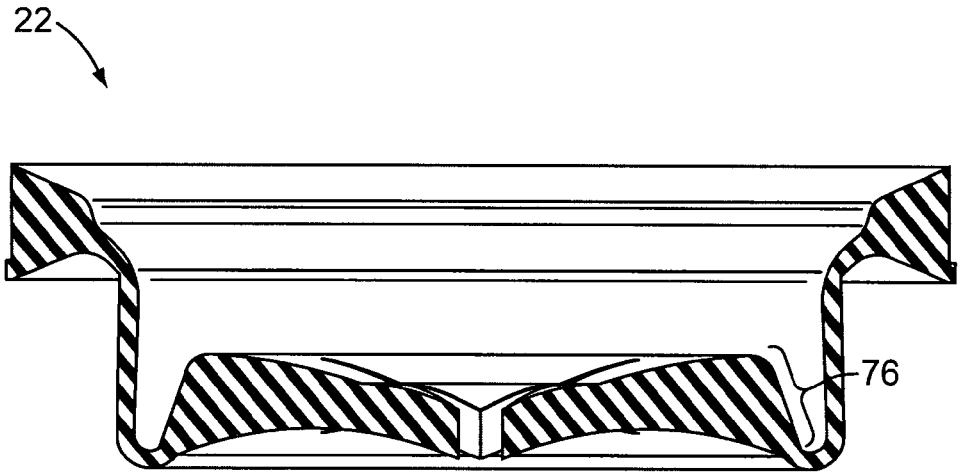
FIG. 17

FIG. 18
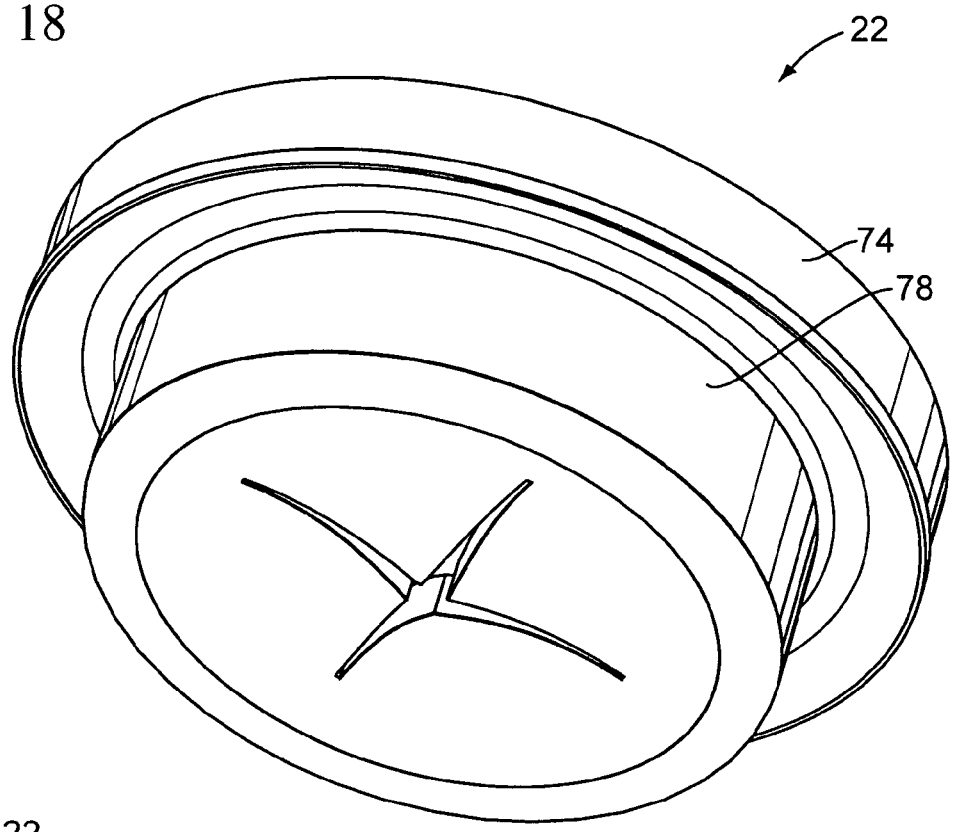
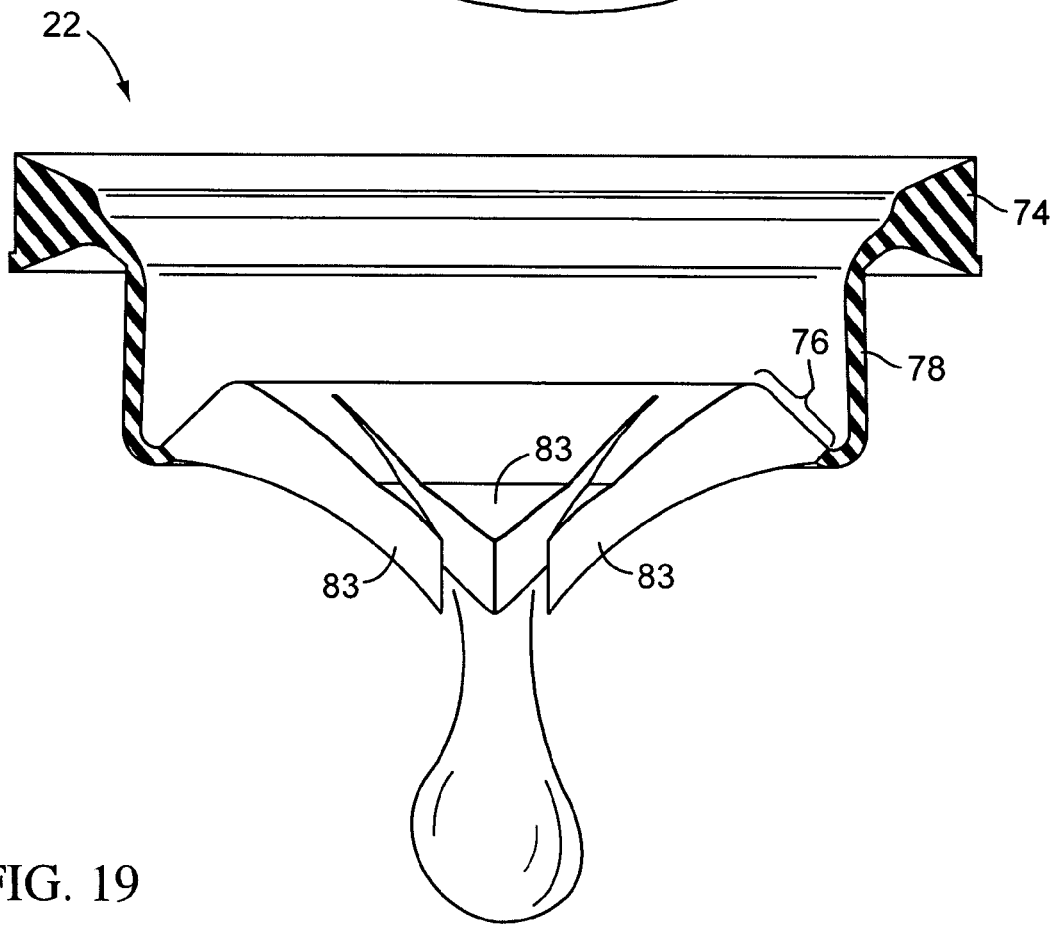
FIG. 19

DISPENSING VALVE WITH HYDRAULIC HAMMER RESISTANCE

TECHNICAL FIELD

The present invention relates to a liquid dispensing system for dispensing liquid from a supply of liquid through a flexible, resilient valve which has a head that defines a normally closed dispensing orifice and that is displaceable outwardly to an open configuration when the pressure on the valve interior side exceeds the pressure on the valve exterior side by a predetermined amount.

BACKGROUND OF THE INVENTION AND TECHNICAL PROBLEMS POSED BY THE PRIOR ART

Various types of liquid supply systems, including portable, dispensing containers, have become popular for use with a variety of fluid substances, including lotions, shampoos, cleaning liquids, beverages, other liquid food products, etc. One type of system includes a container that comprises a generally flexible bottle with a dispensing closure having a dispensing aperture and a cap or lid that is hingedly connected, or releasably attachable, to the body of the closure and that can be opened to expose the dispensing aperture. The bottle can then be tipped, or inverted, and squeezed to discharge the fluid product. The lid can be returned to the closed position to prevent spillage if the container is dropped or tipped over. The closed lid may also help keep the contents fresh and may reduce the ingress of contaminants.

One type of closure for these kinds of containers also includes a flexible, resilient, self-closing, slit-type dispensing valve mounted in the closure over the container opening. The valve has a slit or slits which define a normally closed orifice that opens to permit flow therethrough in response to an increased pressure differentiated across the valve (e.g., resulting from an increased pressure within the container when the container is squeezed, or from a reduced external ambient pressure compared to the pressure within the container). The valve is typically designed so that it automatically closes to shut off flow therethrough upon removal or reduction of the increased internal pressure within the container, or upon an increase of the external pressure.

Designs of such valves and of closures using such valves are illustrated in the U.S. Pat. Nos. 5,271,531, 5,927,566, and 5,934,512. Typically, the closure includes a body or base mounted on the container neck to define a seat for receiving the valve and includes a retaining ring or other structure for holding the valve on the seat in the base. See, for example, U.S. Pat. Nos. 6,269,986 and 6,616,016. The valve is normally closed and can withstand the weight of the fluid product when the bottle is completely inverted so that the liquid will not leak out unless the bottle is squeezed. With such an improved system, the lid or cap need not be re-closed (although it is typically re-closed if the package is to be transported to another location, packed in a suitcase, etc.).

While such a valved dispensing system has significant advantages and functions well, it would be desirable to provide an improved system that would better accommodate more rugged handling or abuse without leaking. Specifically, when the above-described type of valved container is dropped or knocked over, the fluid in the bottle may impact the valve with such force that the valve may momentarily open, and a small amount of liquid may be discharged. Such accelerated, transient, hydraulic pressure effects are sometimes described as a hydraulic hammer or water hammer.

It would be beneficial to provide an improved valve for such a dispensing system which eliminates or greatly minimizes the tendency of the valve to open when the container of liquid is tipped over, dropped, or subjected to a sudden impact. Such an improved valve should also accommodate the normal, easy dispensing of the fluid product.

It would desirable if such an improved valve, when used with a container of liquid product, eliminated or greatly minimized leakage resulting from hydraulic hammer in a number of situations, including, (1) when the user sets the container down on a surface with substantial force and impact, (2) when the user throws the container into a suitcase or other reach in for temporary storage, and that results in vibrations within the container, valve, or product in the container, (3) when the user inverts the container and hits or impacts the container against the user's hand and/or against an adjacent hard surface to move the product toward the dispensing end of the container causing multiple impacts on the valve, and (4) when the container or package is dropped by the user at an angle onto a counter, floor, or other surface creating a side impact on a portion of the package.

It would be particularly advantageous if such an improved valve had the capability to be readily retained within the container or a closure on the container by various means, including by a retaining ring, or by other mechanical means, such a swaging, coining, sonic welding, etc.

It would also be desirable if such an improved valve could also optionally accommodate mounting with a baffle system to further reduce the effects of accelerated hydraulic hammer pressure along with soft impact vibrations. Further, it would be beneficial if such an improved valve could accommodate such a baffle that could be readily or easily removed for cleaning if and when necessary.

It would also be advantageous if such an improved valve could be readily incorporated in a dispensing closure system that could accommodate various liquid supply systems, including bottles, containers, sports hydration backpack fluid dispensing systems, etc., which have a variety of shapes and that are constructed from a variety of materials.

Further, it would be desirable if such an improved valve could accommodate efficient, high-quality, large volume manufacturing techniques with a reduced product reject rate to produce a valve with consistent operating characteristics unit-to-unit.

The present invention provides an improved dispensing valve which can be used in a dispensing system, and which optionally can be incorporated in a novel arrangement with a baffle system, such that the valve or the combination of valve and baffle system can accommodate designs having one or more the above-discussed benefits and features.

SUMMARY OF THE INVENTION

According to one aspect of the present invention, an improved valve, which can be used in a dispensing closure or other dispensing system, is provided with increased resistance to hydraulic hammer caused by accelerated hydraulic pressure increases (e.g., transient liquid pressure increases) on the interior side or inlet side of the valve.

According to one broad aspect of the invention, a fluid dispensing valve is provided with a generally circular configuration relative to a longitudinal axis along which a fluid product or other substance can be dispensed from the valve in a discharge flow direction. The valve has an axially outward direction that is defined by the discharge flow direction. The valve has an axially inward direction that is defined as the direction opposite to the axially outward direction.

The valve includes a peripheral mounting portion (which may include, but is not limited to, a flange). The valve has a head that is flexible and resilient. The head has a normally closed orifice that is defined by at least one slit and that can open to permit a discharge flow of the substance. The valve head has a fully retracted, closed position that is axially inward of at least another part of the valve. The valve head has an exterior surface which can interface with the environment on the valve exterior and has a generally recessed configuration as viewed from the valve exterior when the valve head is in the fully retracted, closed position. The valve head has an interior surface which can interface with the fluid substance on the valve interior. The valve head interior surface has a radially outer surface portion with a convex arcuate configuration when viewed from the valve interior when the valve is in the fully retracted, closed position. The valve head interior surface has a central inner surface portion that (1) is radially inside that radially outer surface portion, (2) bulges axially inwardly to project from the radially outer surface portion, and (3) has a convex arcuate configuration when viewed from the valve interior when the valve is in the fully retracted, closed position.

The valve includes a connector sleeve that (1) is flexible and resilient, (2) defines a generally tubular shape over at least part of the sleeve length, and (3) extends between, and connects, the valve peripheral mounting portion and the valve head in a configuration that, when the valve is subjected to a sufficient pressure differential, doubles over and extends rollingly in the axially outward direction as the valve head moves from the fully retracted, closed position to an extended position that is axially outward of the fully retracted, closed position and that accommodates opening of the orifice.

According to another aspect of the invention, which may be optionally employed with the above-described valve, a baffle system is provided adjacent the valve when the valve is installed in a closure on a container or in another fluid dispensing system. In a preferred embodiment, the baffle system is incorporated in a retaining ring for retaining the valve within a closure or other fitment, and the baffle system further reduces the effects of accelerated hydraulic hammer along with further reducing the effects of soft impact vibrations. In the preferred embodiment that includes the baffle system in a retaining ring, the ring can be removed to permit cleaning of the system components.

When the valve is employed with such a baffle system, the tendency of the valve to leak or prematurely open when the valve and/or fluid is subject to small vibrations or side impact is substantially reduced, if not eliminated.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 9 is an isometric view of the fluid dispensing valve as viewed from the interior side;

FIG. 10 is a side elevational view of the valve;

FIG. 16 is a greatly enlarged plan view of the exterior side of the valve as it starts to open to dispense fluid, and in FIG. 16 the mounting assembly has been omitted;

FIG. 17 is a cross-sectional view taken generally along the plane 17-17 in FIG. 16;

FIG. 18 is an isometric view of the valve as it begins to open in the configuration illustrated in FIGS. 16 and 17; and FIG. 19 is a cross-sectional view similar to FIG. 17, but FIG. 19 shows the valve further opened and dispensing a drop of fluid.

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, many of the figures illustrating the invention show a closure compromising a dispensing valve in a two-piece dispensing fitment, and the closure is shown in the typical orientation that the closure would have at the top of a container when the container is stored upright on its base, and terms such as upper, lower, horizontal, etc., are used with reference to this position. It will be understood, however, that the valve of this invention may be manufactured, stored, transported, used, and sold in an orientation other than the position described.

The valve of this invention is suitable for use with a variety of conventional or special dispensing systems, including in discharge sports hydrations systems and in containers having various designs, the details of which, although not illustrated or described, would be apparent to those having skill in the art and an understanding of such containers. Such containers and systems, perse, that are described herein form no part of, and therefore are not intended to limit, the broadest aspects of the valve, perse, of the present invention. It will also be understood by those of ordinary skill that novel and non-obvious inventive aspects are embodied in the described valve alone.

Figure 1:
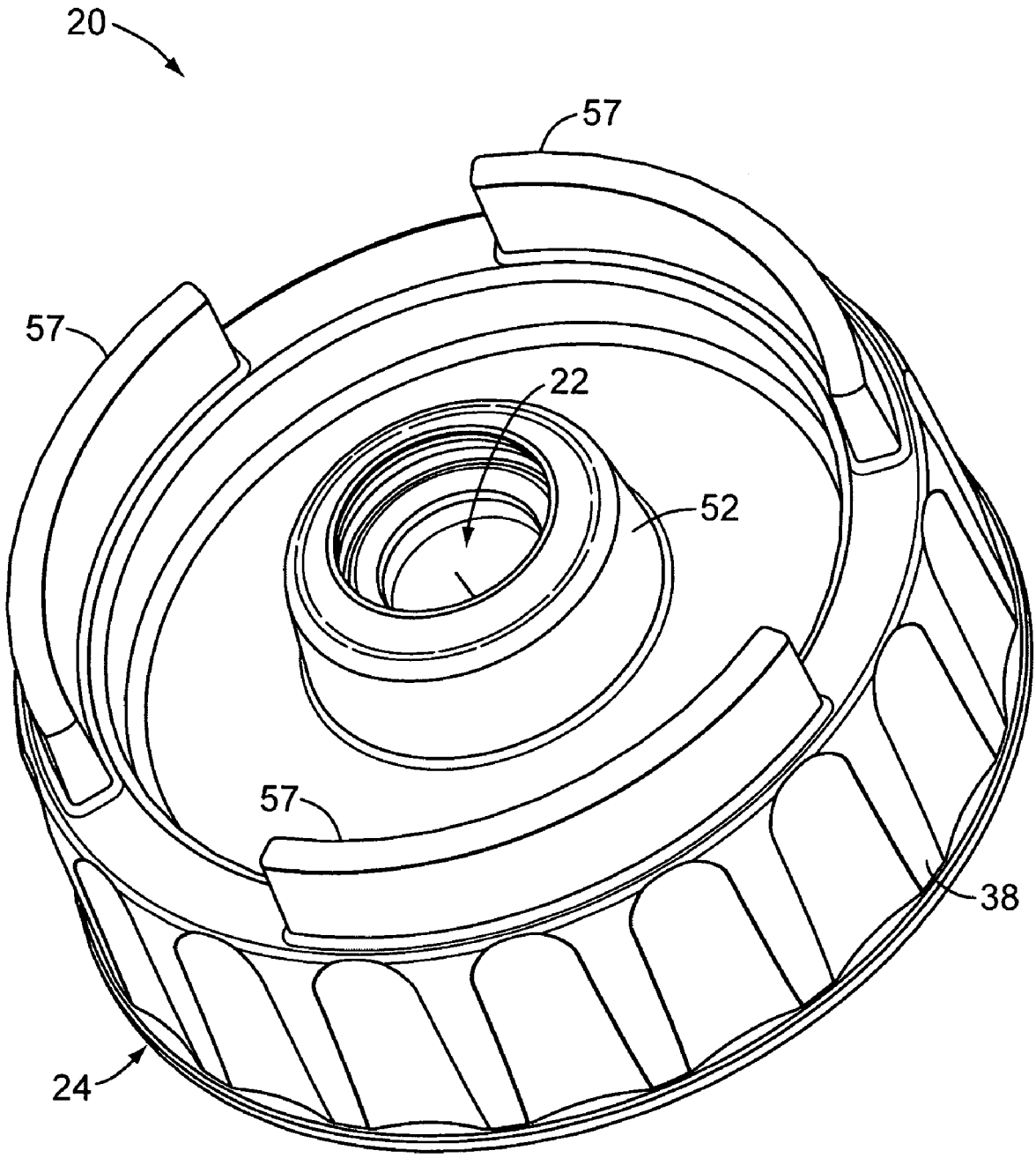
FIG. 1 is an isometric view of a fluid dispensing valve of the present invention contained within a mounting fitment comprising a two-piece mounting assembly whereby the valve and mounting fitment may function together as a closure for a fluid dispensing system such as a fluid dispensing article, device, apparatus, machine, package that includes a container of a fluent substance, etc.
Figure 2:
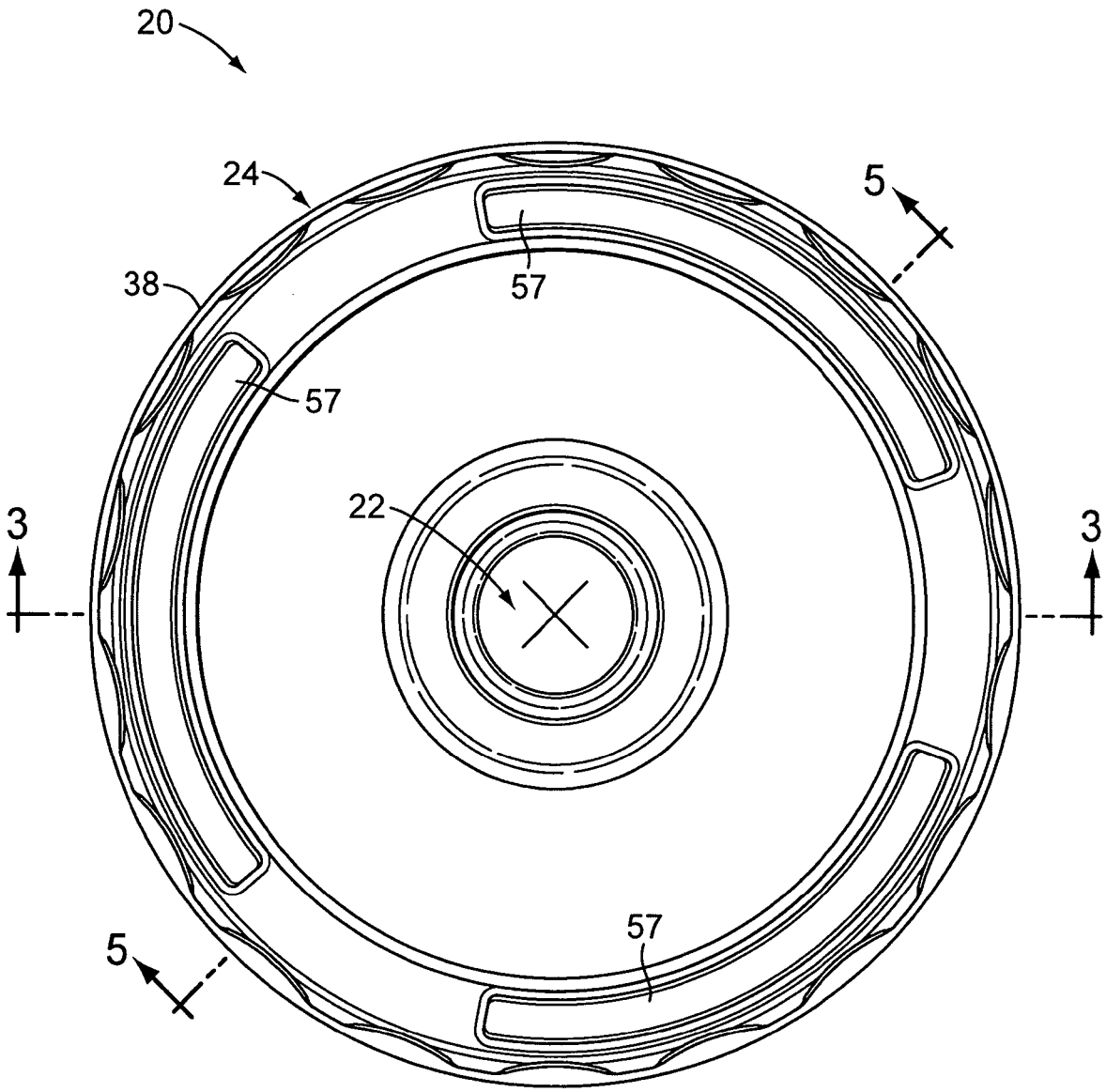
FIG. 2 is a top plan view of the valve in the mounting fitment having the form of a two-piece mounting assembly.

FIGS. 1-19 illustrate a presently preferred embodiment of the dispensing valve of the present invention as part of a dispensing closure system or closure that is designated generally by reference number 20 in FIG. 1. In the preferred embodiment illustrated, the dispensing closure 20 includes a dispensing valve 22 that is held in a mounting fitment 24 that has the form of a two-piece mounting assembly. The valve 22 and fitment 24 together are regarded on the closure 20. The illustrated preferred form of the closure 20 is especially adapted to be mounted or installed on a container (not shown) that would typically contain a fluent material. The container would typically include (1) a body and/or neck defining an opening to the container interior, and (2) an external, male thread for engaging a mating female thread on the dispensing closure 20. The dispensing closure 20 may also be mounted on other types of fluent material dispensing apparatus or systems.

Where the closure 20 is mounted on a container, the container may have a body with any suitable configuration, and the upwardly projecting neck may have a different cross-sectional size and/or shape than the container body. (Alternatively, the container need not have a neck, perse. Instead, the container may consist of just a body with an opening.) The container typically would have a somewhat flexible wall or walls.

Although the container, perse, does not form a part of the broadest aspects of the present invention, perse, it will be appreciated that at least a portion of the closure 20 optionally may be provided as a unitary portion, or extension, of the top of the container. However, in the preferred embodiment illustrated, the dispensing closure 20 is a completely separate article or unit (e.g., a separate dispensing closure 20) which can comprise either one piece or an assembly of multiple pieces, and which is adapted to be removably, or non-removably, installed on a previously manufactured container (or other fluent material dispensing apparatus). Hereinafter, the dispensing closure 20 will be more simply referred to as the closure 20.

The illustrated, preferred embodiment of the closure 20 is adapted to be used with a container having an opening to provide access to the container interior and to a product contained therein. The closure 20 can be used to dispense with many materials, including, but not limited to, liquids, suspensions, mixtures, etc. (such as, for example, a material constituting a personal care product, a food product, an industrial or household cleaning product, or other compositions of matter (e.g., compositions for use in activities involving manufacturing, commercial or household maintenance, construction, agriculture, medical treatment, military operations, etc.)).

The container with which the closure 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure around the exterior of the closure so as to suck the material out through the open closure.

It is presently contemplated that many applications employing the closure 20 will conveniently be realized by molding at least some of the components of the closure mounting fitment 24 from suitable thermoplastic material or materials. In the preferred embodiment illustrated, the closure mounting fitment 24 (in which the valve 22 is mounted) includes components molded from a suitable thermoplastic material, such as, but not limited to, polypropylene. The closure components may be separately molded—and may be molded from different materials. The materials may have the same or different colors and textures. In one contemplated embodiment (not illustrated), the valve could be attached to a unitary mounting fitment. The unitary mounting fitment could be molded to form a generally rigid, unitary structure (rather than a multi-piece structure), and then the valve 22 could be bi-injection molded onto the fitment to form the completed closure.

Figure 3:
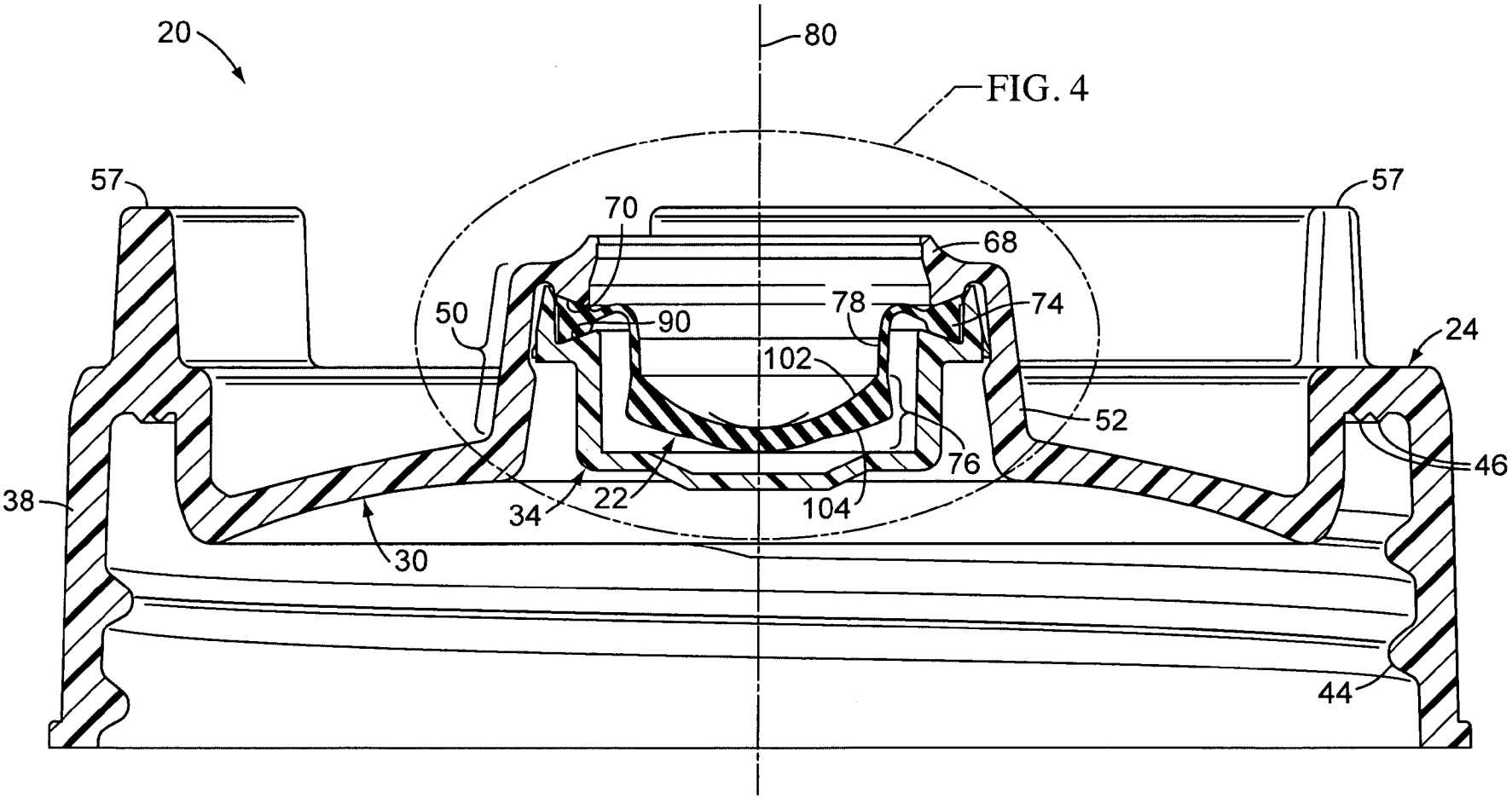
FIG. 3 is an enlarged, cross-sectional view taken generally along the plane 3-3 in FIG. 2.

As can be seen in FIG. 3, the presently most preferred form of the closure 20 includes three basic components, (1) the valve 22, (2) a unitary molded body 30, and (3) a retaining ring, or mounting ring, or clamp member 34 that retains the valve 22 in the body 30. The body 30 and ring 34 together define the mounting fitment 24 in the form of a two-piece mounting assembly. The closure 20 could also include a lid (not illustrated) that is attached with a hinge or tether, or that is completely removable.

As can be seen in FIG. 3, the body 30 includes a skirt 38 that extends downwardly and defines an internal, female thread 44 for threadingly engaging the container neck external, male thread (not illustrated) when the dispensing closure 20 is installed on the container neck.

Alternatively, the closure body 30 could be provided with some other container connecting means, such as a snap-fit bead or groove (not illustrated) for engaging a container neck groove or bead (not illustrated), respectively. Also, the closure body 30 could instead be permanently attached to the container by means of induction melting, ultrasonic melting, gluing, or the like, depending on materials used for the closure body 30 and container. The closure body 30 could also be formed as a unitary part, or extension, of the container.

The closure body 30 may have any suitable configuration for accommodating an upwardly projecting neck of the container or for accommodating any other portion of a container received within the particular configuration of the closure body 30—even if a container does not have a neck, perse. The main part of the container may have a different cross-sectional shape than the container neck and closure 30. The closure body 30 may also be adapted for mounting to other types of dispensing apparatus, machines, or equipment.

Preferably an interior, annular seal structure 46 (FIG. 3) extends downwardly from the underside of the closure body 30 adjacent the skirt 38. Such a seal structure could be a conventional double "V" seal as illustrated, or a "plug" profile seal, a "crab's claw" seal, a flat seal, or some other such conventional or special seal, depending upon the particular application.

As can be seen in FIG. 3, the closure body 30 includes an upwardly projecting spout 50. The spout 50 includes an annular wall 52 to provide an internal space for accommodating the mounting ring 34 and the movement of the valve 22 from the retracted, closed position (illustrated in dashed lines in FIG. 14) to a partially extended position (illustrated in solid lines in FIG. 15) and to the fully extended, open position (FIG. 19). The inside of the spout 50 may be characterized as defining a discharge passage in the closure body 30.

The closure body 30 includes an optional feature comprising three upwardly projecting walls 57 (FIGS. 1-3), and these walls 57 can help prevent or minimize contact or impact of the spout 50 and valve 22 with exterior objects or surfaces.

An annular flange structure 68 (FIG. 3) extends inwardly from the upper end of the annular wall 52 of the spout 50. The flange structure 68 defines a dispensing aperture surrounded by an annular seat 70 (FIG. 4), preferably in the configuration of a frustoconical surface, for being engaged by a peripheral portion of the valve 22 as described hereinafter. This accommodates the seating of the valve 22 in the closure body 30. The surface 70 functions as an annular, downwardly angled clamping surface for engaging the peripheral part of the valve 22 as explained in detail hereinafter.

The valve 22 is adapted to be mounted in the closure body 30 as shown in FIG. 3. The preferred embodiment of the valve 22 is a pressure-actuatable, flexible, slit-type valve which is retained on the inside of the closure body 30 by means of the retaining ring 34 as described in detail hereinafter.

The valve 22 is preferably molded as a unitary structure from material which is flexible, pliable, elastic, and resilient. This can include elastomers, such as a synthetic, thermosetting polymer, including silicone rubber, such as the silicone rubber sold by Dow Corning Corp. in the United States of America under the trade designation D.C. 99-595-HC. Another suitable silicone rubber material is sold in the United States of America under the designation WACKER 3003-40 silicone rubber material by Wacker Silicone Company. Both of these materials have a hardness rating of 40 Shore A. The valve 22 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

In the preferred embodiment illustrated, the valve 22 incorporates much of the configuration of a commercially available valve design substantially as disclosed in the U.S. Pat. No. 5,676,289 with reference to the valve 46 disclosed in the U.S. Pat. No. 5,676,289. The configuration and operation of such a type of valve is further described with reference to the similar valve that is designated by reference number 3d in the U.S. Pat. No. 5,409,144.

Figure 13:
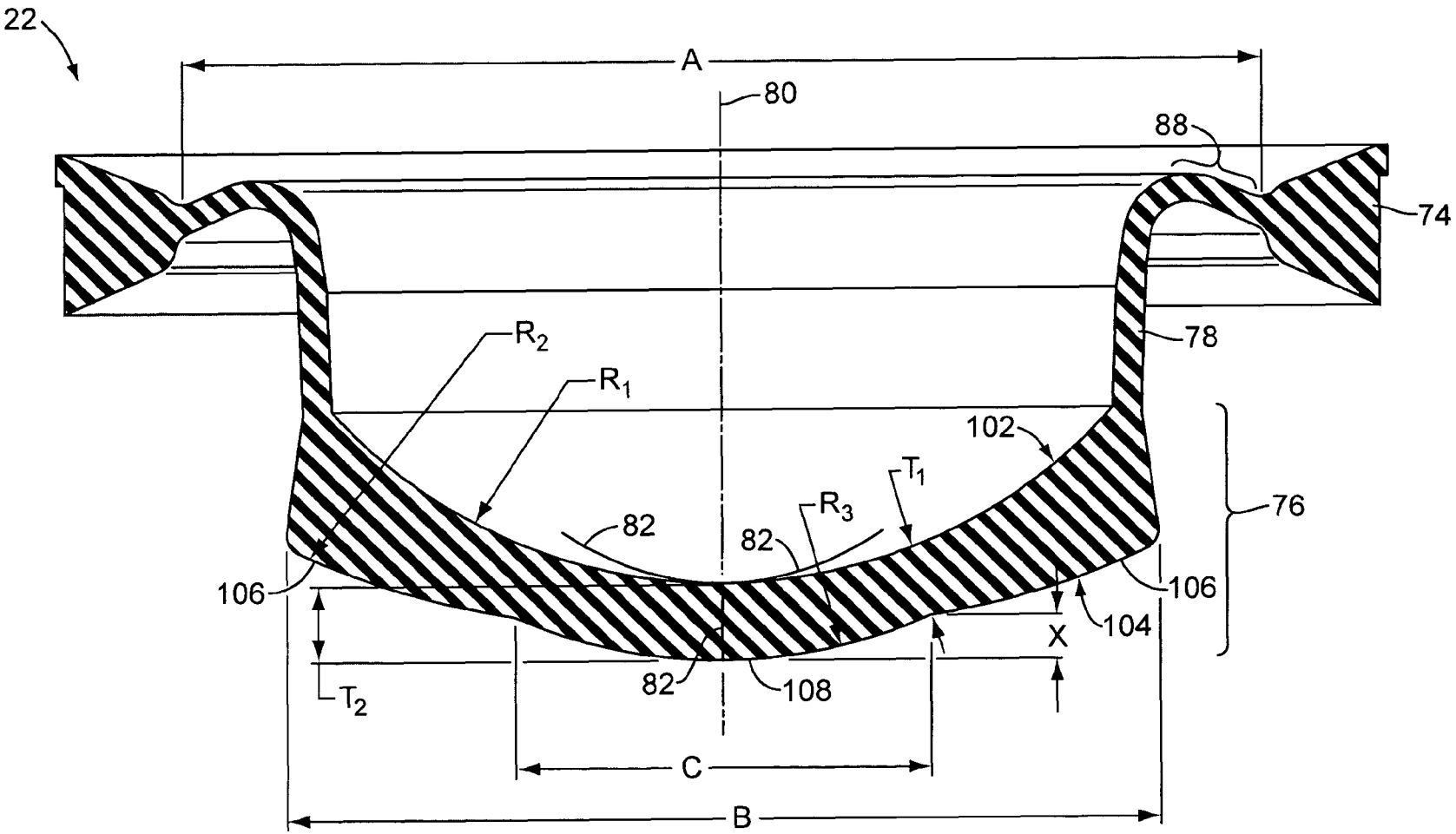
FIG. 13 is a greatly enlarged, cross-sectional view taken generally along the plane 13-13 in FIG. 11.

The valve 22 is flexible and changes configuration between (1) a retracted, closed, rest position (as shown closed in FIG. 3 in the closure 20 having an orientation that the closure 20 would have if mounted on a container in an upright package), and (2) an extended, active, open position (as shown in FIG. 19 when the package is in an inverted position to dispense a fluid product). With reference to FIG. 13, the valve 22 includes a peripheral mounting portion or flange 74, a flexible, central, valve head portion or head 76, and a connector sleeve 78 that extends between, and connects, the flange 74 and head 76. When the valve 22 is not actuated, the head 76 has a concave configuration (when viewed from the exterior of the closure 20 as shown in FIG. 3).

In the illustrated, preferred embodiment, the valve 22 has a generally circular configuration about the central longitudinal axis 80 extending through the valve 22 (FIG. 3). In the preferred embodiment illustrated, the flange 74, sleeve 78, and head 76 are oriented in a generally circular configuration and concentric relationship relative to a longitudinal axis 80 (FIG. 3) along which the fluid substance can be dispensed from the valve 22 in a discharge flow direction. The valve 22 (FIG. 3) may be characterized as having an axially outward direction that is defined by the discharge flow direction. The valve 22 may also be characterized as having an axially inward direction that is defined as a direction opposite to the axially outward direction.

Figure 11:
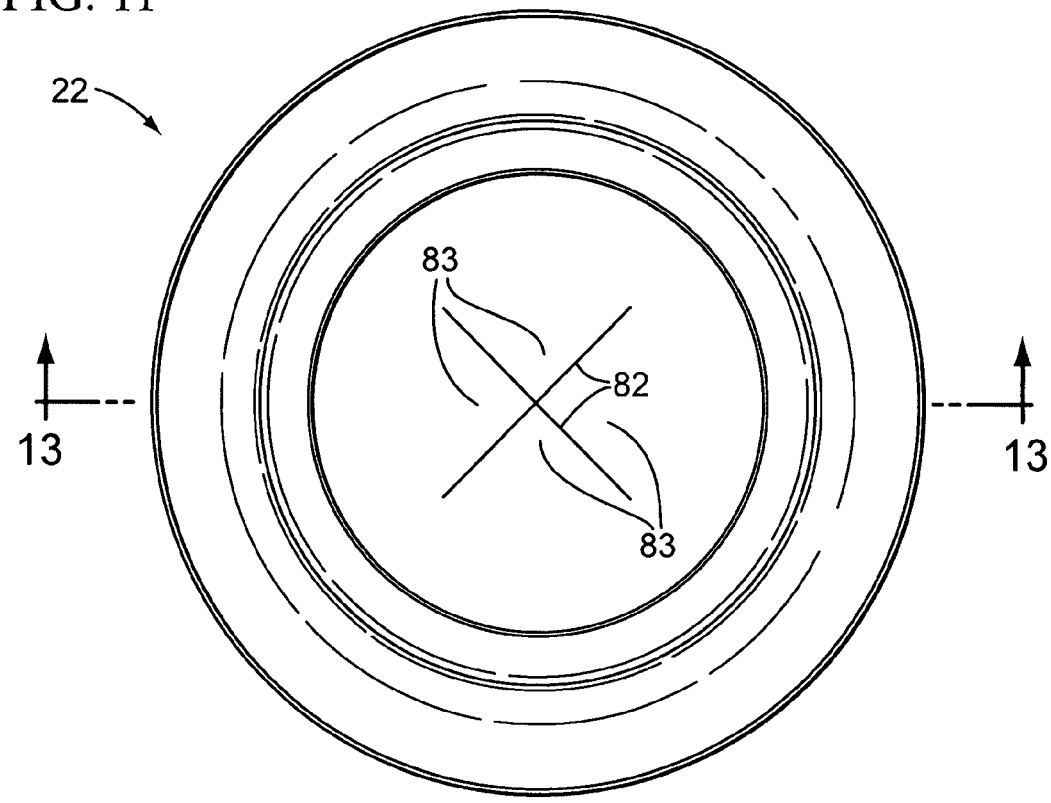
FIG. 11 is a top plan view of the exterior side of the valve as taken generally along the plane 11-11 in FIG. 10.

The head 76 of the valve 22 has a dispensing orifice which, in the preferred embodiment, is defined by one or more slits 82 (FIGS. 9, 11, and 13). Preferably, there are two or more slits 82 radiating from the longitudinal axis 80. More preferably, there are four slits 82 that radiate from the axis 80. The four radiating slits 82 may be alternatively characterized as two intersecting cross slits 82. A lesser or greater number of slits 82 could be used. The slits 82 preferably extend transversely through the thickness of the head 76 parallel to the longitudinal axis 80.

In the illustrated preferred embodiment, the slits 82 extend laterally from a common origin on the longitudinal axis 80 to define four flaps or petals 83 (FIG. 11) which can flex outwardly (as seen in FIG. 19) to selectively permit the flow of product from the container through the valve 22. The flaps 83 open outwardly from the intersection point of the slits 82 in response to an increasing pressure differential across the valve, when the pressure differential is of sufficient magnitude as generally described in the U.S. Pat. No. 5,409,144.

Each slit 82 terminates in a radially outer end in the valve head 76. In the illustrated preferred embodiment, the slits 82 are of equal length, although the slits 82 could be of unequal length. In the preferred embodiment, each slit 82 is planar, and the plane of each slit 82 contains the central, longitudinal axis 80 of the valve 22. Preferably, the slits 82 diverge from an origin on the longitudinal axis 80 and define equal size angles between each pair of adjacent slits 82 so that the flaps 83 are of equal size. Preferably, the four slits 82 diverge at 90 degree angles to define two mutually perpendicular, intersecting, longer slits. Preferably, the slits 82 are formed so that the opposing side faces of adjacent valve flaps 83 closely seal against one another when the dispensing orifice is in its normal, fully closed position. The length and location of the slits 82 can be adjusted to vary the predetermined opening pressure of the valve 22, as well as other dispensing characteristics.

The valve 22 could be molded with the slits 82. Alternatively, the valve slits 82 could be subsequently cut into the central head 76 of the valve 22 by suitable conventional techniques.

The valve 22 connector skirt or sleeve 78 extends from the valve central wall or head 76 to the peripheral mounting portion 74. At the outer end of the sleeve 78, there is a thin, annular flange 88 (FIG. 13) which extends peripherally as part of the sleeve 78 in a reverse angled orientation. The thin flange 88 merges with the enlarged, much thicker, peripheral mounting portion or flange 74 which has a generally dovetail-shaped, longitudinal cross section (as viewed in FIG. 13).

Figure 4:
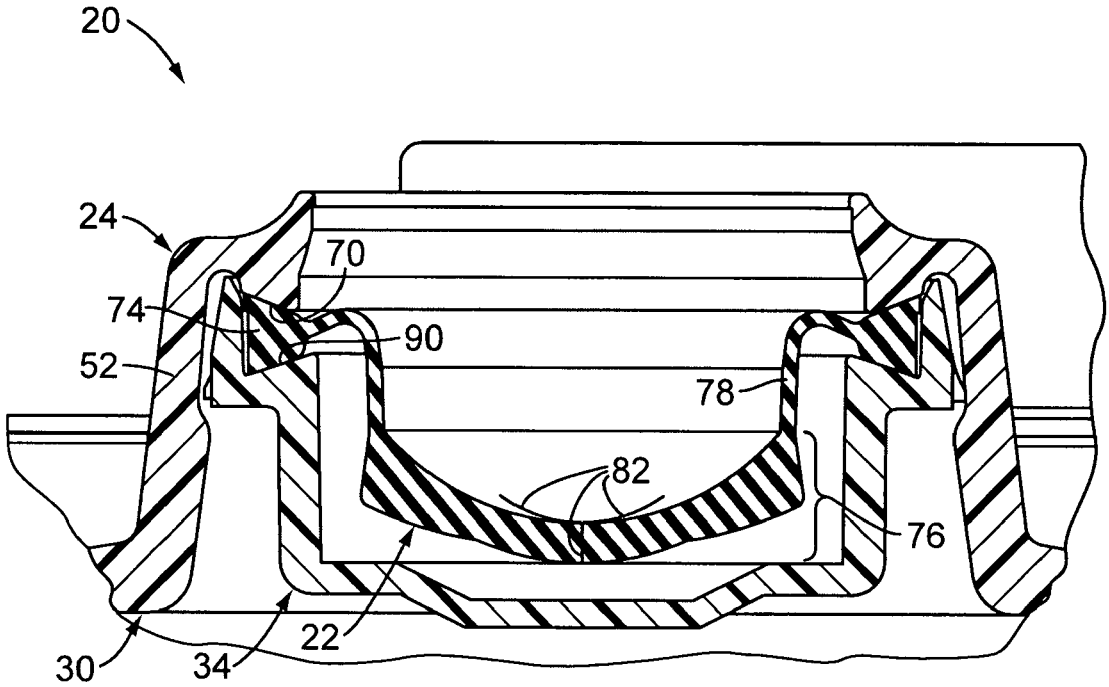
FIG. 4 is a greatly enlarged, cross-sectional view of the FIG. 3 area within the oval designated "FIG. 4" in FIG. 3.

To accommodate the seating of the valve 22 in the closure body 30 (as shown in FIGS. 3 and 4), the top surface of the dovetail valve flange 74 has the same frustoconical configuration and angle as the closure body frustoconical surface 70.

The other surface (i.e., bottom surface) of the valve flange 74 is clamped by the retaining ring 34 (FIGS. 3 and 4). The retaining ring 34 includes an upwardly facing, frustoconical, annular clamping surface 90 (FIGS. 3 and 4) for engaging the inner surface (i.e., bottom surface) of the valve flange 74 at an angle which matches the angle of the adjacent, inner surface of the dovetail configuration valve flange 74.

The peripheral portion of the retaining ring 34 includes an outwardly projecting shoulder or bead 94 (FIGS. 6 and 7) for snap-fit engagement with the inside of the closure body spout 50 adjacent a bead 98 (FIG. 6) projecting inwardly from the spout annular wall 52, and this holds the ring 34 tightly in the spout 50 so as to clamp the valve 22 tightly inside the spout 50. The interior of the ring 34 is large enough to permit the region adjacent the interior surface of the valve sleeve 78 to be substantially open, free, and clear so as to accommodate movement of the valve sleeve 78 as described hereinafter.

The novel configuration of the valve 22 will next be more specifically described with reference to FIG. 13. The valve head 76 may be characterized as having an exterior surface 102. The exterior surface 102 can interface with environment on the valve exterior. The exterior surface 102 has a generally recessed configuration as viewed from the valve exterior when the valve head 76 is in the fully retracted, closed positions (as shown in FIGS. 3 and 13).

Figure 12:
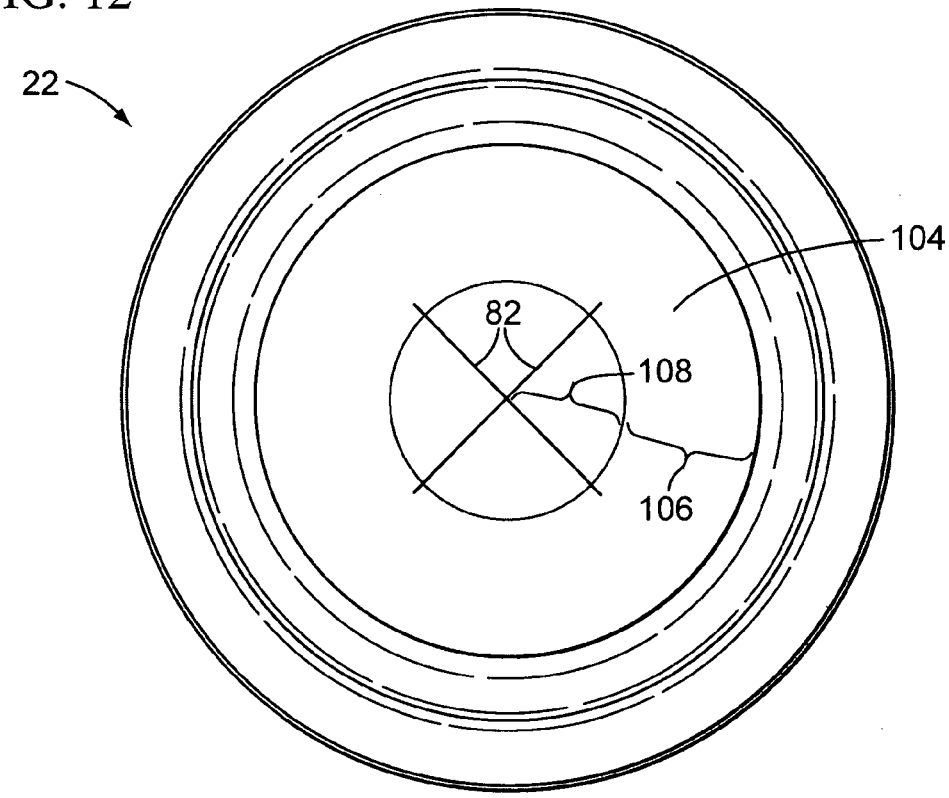
FIG. 12 is a bottom plan view of the interior side of the valve taken generally along the plane 12-12 in FIG. 10.

The valve head 76 also includes an interior surface 104. The interior surface 104 can interface with fluid substance on the valve interior. As can be seen in FIGS. 10, 12 and 13, the valve head interior surface 104 includes a radially outer surface portion 106 with a convex arcuate configuration when viewed from the valve interior when the valve is in the fully retracted, closed position. The valve head interior surface 104 further includes a central inner surface portion 108 that (i) is radially inside the radially outer surface portion 106, (ii) bulges axially inwardly (toward the inside of the container or other dispensing apparatus on which the closure 20 is mounted) so as to project from the radially outer surface portion 106, and (iii) has a convex, arcuate configuration when viewed from the valve interior when the valve is in the fully retracted, closed position.

As can be seen in FIG. 13, in the preferred embodiment of the valve 22, the valve orifice slits 82 each extends radially outwardly to at least the radially outer surface portion 106 (see also FIG. 9).

The connector sleeve 78 extends from the peripheral portion of the valve head 76 and defines a generally tubular shape over at least part of the sleeve length. The connector sleeve 78 is relatively flexible and resilient so that when the valve 22 is subjected to a sufficient pressure differential, the sleeve 78 can double over and extend rollingly (FIGS. 14 and 15) in the axially outward direction (away from the container interior) as the valve head 76 moves from the fully retracted, closed position (FIGS. 3 and 13) to an extended position (FIG. 19) that is axially outward of the fully retracted, closed position whereby the opening of the orifice defined by the slits 82 is accommodated.

Figure 14:
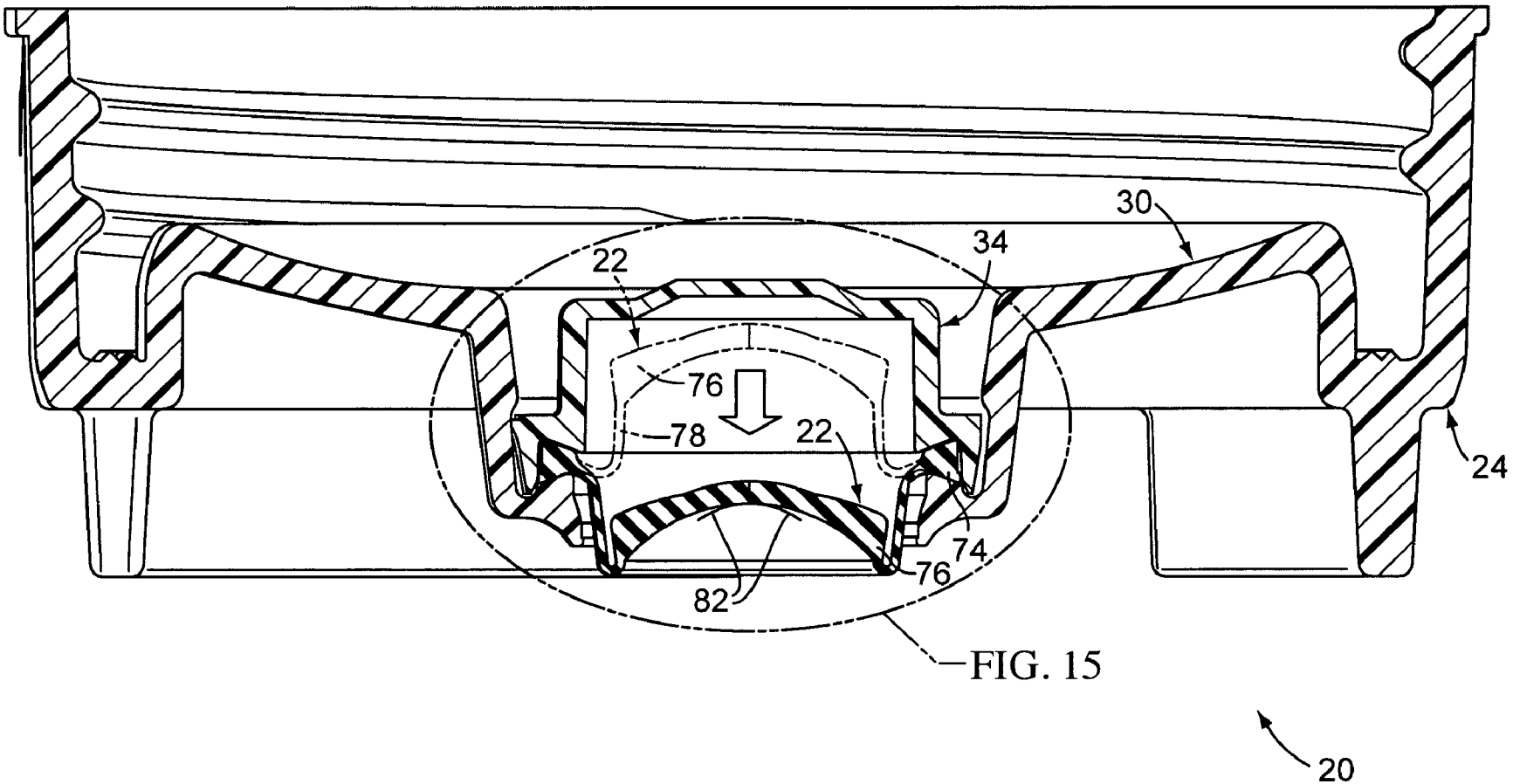
FIG. 14 is a view similar to FIG. 3, but FIG. 14 shows the valve subjected to a pressure differential (e.g., wherein the interior side pressure exceeds the exterior side pressure), and the valve is shown moved to an extended position.

With reference to FIG. 14, and with particular reference to the phantom position of the valve 22 shown in dashed lines, the sleeve 78 has a generally J-shaped cross section when the valve 22 is positioned so that the longitudinal axis is vertically oriented with the valve head up and with the peripheral mounting portion 74 down. Also, as can be seen in FIG. 13, in the preferred embodiment, the tubular wall of connector sleeve 78 has a generally uniform cross section.

In the presently preferred embodiment illustrated in FIG. 13, the valve head exterior surface 102 lies on a partially spherical locus that defines a circular arc in longitudinal cross section as viewed along a plane containing the longitudinal axis 80. The radius of the circular arc spherical exterior surface 102 is designated in FIG. 13 by the reference character $R_1$.

As illustrated in FIG. 10, the valve head interior surface radially outer surface portion 106 is partially spherical, and as can be seen in FIG. 13, the partially spherical radially outer surface portion 106 defines a circular arc $R_2$ as viewed in longitudinal cross section along a plane containing longitudinal axis 80.

As can be seen in FIG. 10, the valve head interior surface central inner surface portion 108 is a partially spherical surface, and as can be seen in FIG. 13, the interior surface of the partially spherical central inner surface portion 108 defines a circular arc having a radius $R_3$ when viewed in longitudinal cross section along a plane containing the longitudinal axis 80.

The combination of circular arc configurations and the associated radii $R_1$, $R_2$ and $R_3$ are a preferred embodiment only, and are not intended to limit the particular surface shapes of the valve head 76.

In the preferred embodiment, the thickness of the central portion of the valve head 76 between the exterior surface 102 and the interior surface of the central inner surface portion 108 is not uniform. In the presently most preferred embodiment illustrated in FIG. 13, the valve head central inner surface portion circular arc radius $R_3$ is just slightly less than the radius $R_1$ of the valve head partially spherical exterior surface 102, and the origin point of the radius $R_1$ is located further toward the exterior along the axis 80 compared to the origin point of the radius $R_3$.

In a presently most preferred form of the invention for one typical valve size, the outermost diameter of the connector sleeve 78 where it attaches to the peripheral mounting portion 74 is about 12.98 mm as indicated by reference character A in FIG. 13.

The outermost diameter of the valve head 76 is indicated by the reference character B in FIG. 13, and in the presently most preferred embodiment for one typical valve size, B is about 10.67 mm.

In the presently most preferred form of the invention for one typical valve size, the diameter of the central inner surface portion 108, designated at the circumference of the central inner surface portion 108 by reference character C in FIG. 13, is about 5.08 mm. Diameter C can also be characterized as the diameter corresponding to the inner radius of the partially spherical outer surface portion 106.

For one typical valve size, the preferred radius $R_1$ is about 6.35 mm, the preferred radius $R_2$ is about 9.78 mm, and the preferred radius $R_3$ is about 6.15 mm. Thus, in the preferred embodiment, the radius of the valve head exterior surface 102 is slightly greater than the radius of the valve head interior surface central inner surface portion 108 so that the thickness of the valve head 76 at the center of the intersecting slits 82, as designated by the reference character $T_2$ in FIG. 13, is slightly greater than the valve head thickness at the periphery of the central inner surface portion 108 as indicated by reference character $T_1$ in FIG. 13. In the presently preferred form of the invention for one typical valve size, $T_1$ is about 0.86 mm and $T_2$ is about 0.97 mm.

As illustrated in FIG. 13, the central inner surface portion 108 projects and amount X outwardly beyond its periphery or circumference that is defined at the inner radius of the radially outer surface portion 106. In the presently preferred embodiment, the project dimension X is about 0.65 mm.

In one typical valve size for a presently preferred embodiment, the following relationships are preferred:

the projection dimension X (FIG. 13) is about 65 percent of the valve head thickness $T_1$ at the periphery of the central inner surface portion 108, the diameter C of the periphery of the central inner surface portion 108 is about 47 percent of the valve head exterior diameter B, and the valve head exterior diameter B is about 80 percent of the valve sleeve peripheral diameter A as measured where the valve sleeve 78 connects to the valve mounting portion 74.

Further, in a presently preferred embodiment, the radius $R_3$ (FIG. 13) of the central inner surface portion 108 is about 97 percent of the radius $R_1$ of the valve head exterior surface 102 (FIG. 13).

Further, in the presently preferred embodiment, the valve head thickness $T_2$ at the center of the valve head is about 65 percent of the thickness $T_1$ of the valve head 76 at the outer periphery or circumference of the central inner surface portion 108.

Also, in the preferred embodiment, the projection distance X (FIG. 13) of the central inner surface portion 108 is about 11 percent of the diameter C of the central inner surface portion 108 (FIG. 13).

In the presently preferred form of the invention for one typical valve size, the following relationships are preferred:

the valve head interior surface central inner surface portion outer diameter C is between about 33 percent and about 66 percent of the valve head interior surface radially outer surface portion outer diameter B;

the distance X that the valve head interior surface central inner portion 108 projects or bulges in the axially inward direction beyond the axial location the circumference of the valve head interior surface central inner surface portion 108 (defined at diameter C) is between about 5 percent and 25 percent of the diameter C of the valve head interior surface central inner surface portion 108; and the valve head interior surface central inner surface portion bulges in the axially inward direction from its circumference for a distance X between about 25 percent and about 75 percent of the thickness of the valve head at the center along the longitudinal axis.

In some applications, it is preferable to use the valve 22 with an optional baffle structure on the interior side of the valve. In the preferred embodiment illustrated in the figures, a baffle structure is incorporated as part of the retainer ring 34 as will next be explained in more detail with reference to FIGS. 6, 7 and 8 which illustrate the retainer ring 34.

Figure 7:
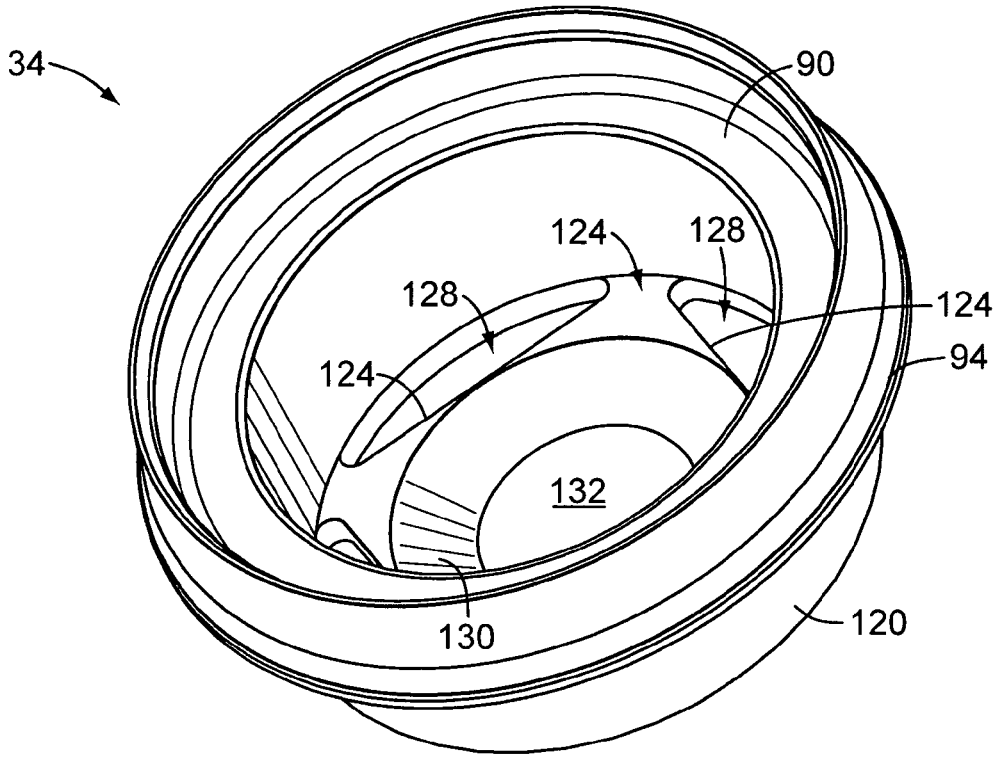
FIG. 7 is a isometric view of the retainer ring removed from the mounting assembly and as viewed from the exterior side of the mounting ring.
Figure 8:
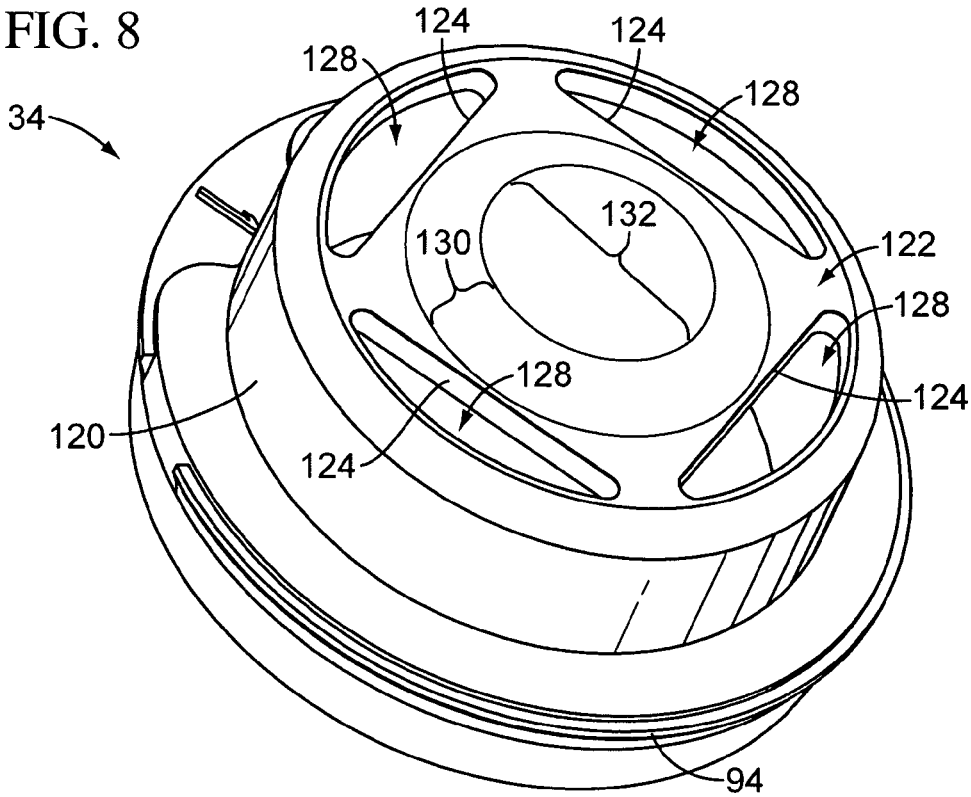
FIG. 8 as an isometric view of the mounting ring as viewed from the interior side of the mounting ring.

As can be seen in FIGS. 7 and 8, the retainer ring 34 has a downwardly extending, generally annular wall 120. Across the bottom of the annular wall 120 is a generally square baffle plate 122 connected at each of its four corners to the annular wall 120. The baffle plate 122 has four side edges 124 which are each spaced inwardly from the annular wall 120 to define four peripheral apertures 128 which accommodate a flow of the fluid product or other substance to be dispensed from the container or other dispensing apparatus.

Figure 6:
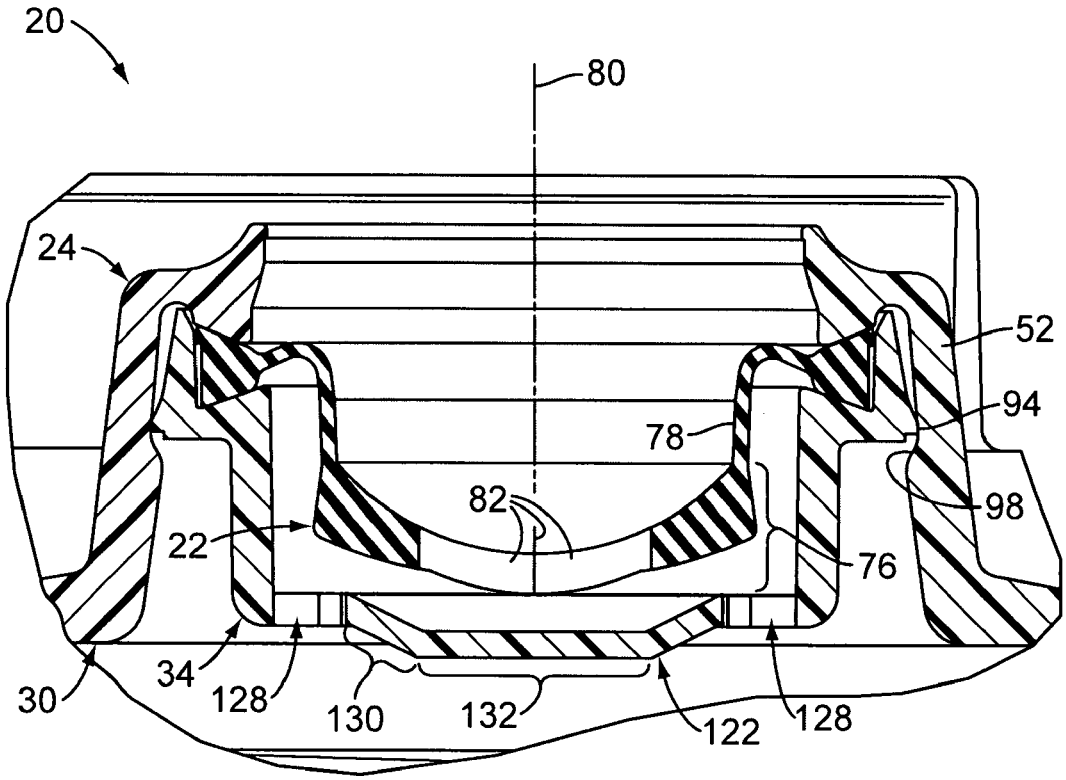
FIG. 6, on sheet 4 of 13 with FIG. 4, is a greatly enlarged, cross-sectional view of the FIG. 5 area within the oval designated "FIG. 6" in FIG. 5.
Figure 5:
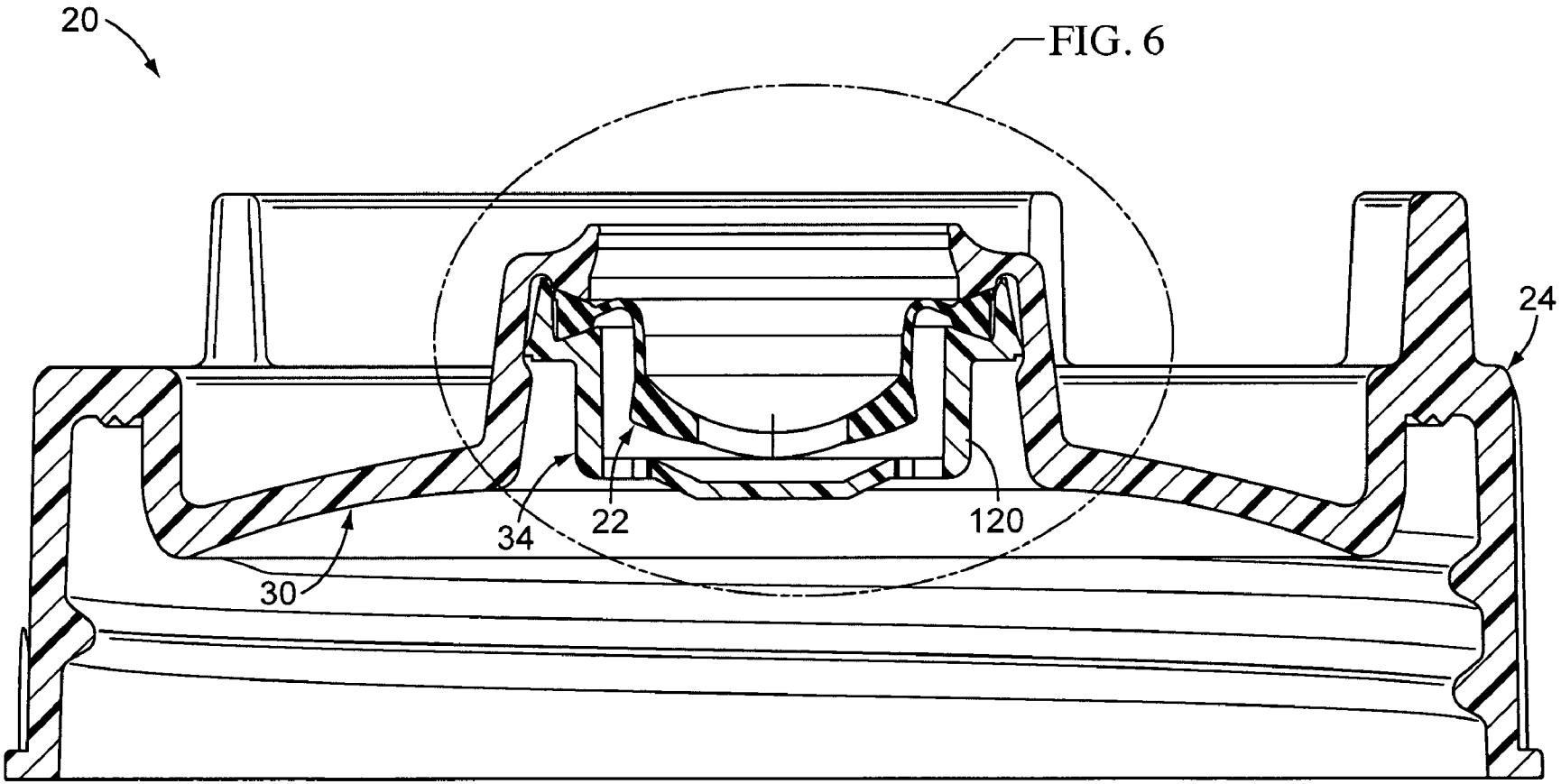
FIG. 5 is an enlarged, cross-sectional view taken generally along the plane 5-5 in FIG. 2.

As can be seen in FIG. 6, the portion of the baffle plate 122 inwardly of the edges 124 has a dished like configuration defined by a frustoconical upper wall 130 and a generally flat, circular bottom wall 132. The wall 130 and 132 of the baffle plate 122 define a somewhat recessed configuration (recessed inwardly toward the interior of the container) which somewhat corresponds to, or follows, the inwardly projecting configuration of the valve head 76 as can be seen in FIG. 6. Further, as can be seen in FIG. 6, the central, bottom wall 132 of the baffle plate 122 has approximately the same diameter of the slits 82, and the baffle plate bottom wall 132 is aligned generally in registry with the slits 82 relative to the longitudinal axis 80. Further, with reference to FIG. 6, it will be noted that the baffle plate apertures 128 are located adjacent the outer periphery edge of the valve head 76 so that a fluid substance flowing through the apertures 128 toward the valve 22 will impact the valve 22 primarily on the peripheral edge or circumference of the valve head 76 and on the interior side of the valve connecting sleeve 78.

In order to dispense product, the package is typically tipped downwardly, or is completely inverted, and then squeezed. FIG. 14 shows orientation of a valve 22 when the package is inverted and the container is squeezed. (Or, alternatively, the exterior atmospheric pressure could be reduced adjacent the exterior side of the valve 22.) The container is typically squeezed to increase the pressure within the container above the ambient exterior atmospheric pressure. This forces the product in the container toward and against the valve 22, and that forces the valve 22 from the recessed or retracted position (shown in phantom with dashed lines in FIG. 14) toward an outwardly extending position (shown in solid lines in FIGS. 14 and 15). The outward displacement of the central head 76 of the valve 22 is accommodated by the relatively thin, flexible sleeve 78. The sleeve 78 moves from an inwardly projecting, rest position (shown in phantom in dashed lines in FIG. 15) to an outwardly displaced, pressurized position, and this occurs as a result of the sleeve 78 "rolling" along itself outwardly toward the outer end of the package (toward the position shown in solid lines in FIGS. 14 and 15).

Figure 15:
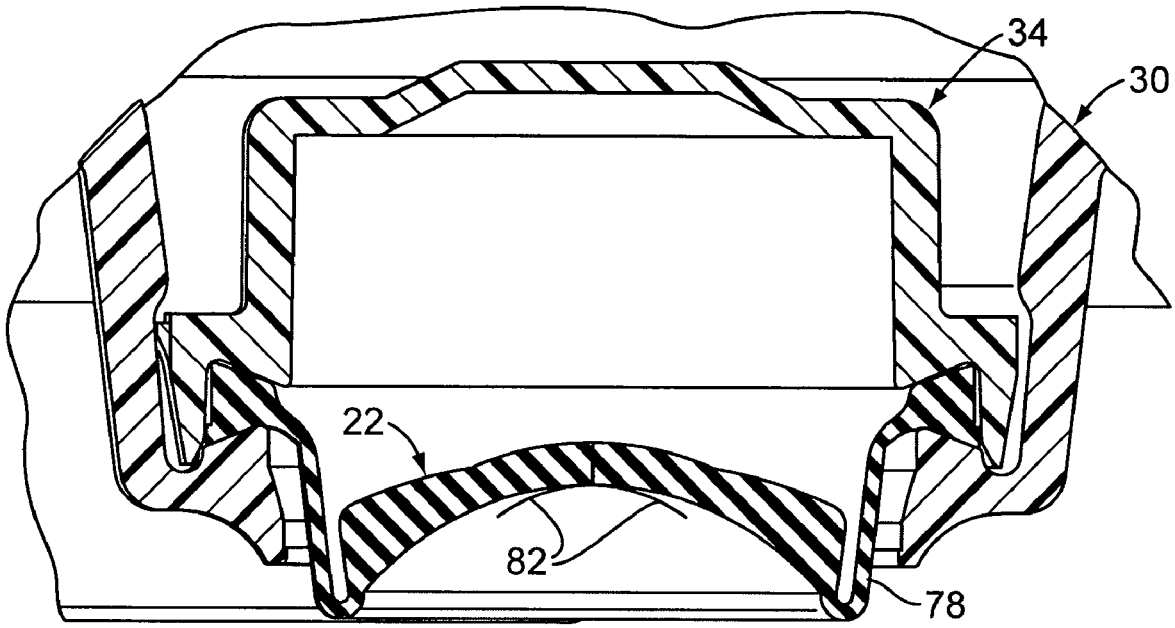
FIG. 15 is a greatly enlarged, fragmentary view of the FIG. 14 area within the oval designated "FIG. 15" in FIG. 14.

During the valve opening process, the valve head 76 is initially displaced outwardly while still maintaining its generally concave, closed configuration (FIGS. 14 and 15). The initial outward displacement of the closed, concave head 76 is accommodated by the relatively, thin, flexible, sleeve 78. The sleeve 78 moves from a recessed, rest position to a pressurized position wherein the sleeve 78 extends outwardly toward, and may preferably extend beyond, the open end of the structure in which the valve 22 is mounted. That is, the sleeve 78 extends axially outward (i.e., outwardly in the discharge flow direction of the substance to be dispensed through the valve 22). However, the valve 22 does not open (i.e., the slits 82 do not open) until the valve head 76 has moved substantially all the way to a fully extended position. Indeed, as the valve head 76 moves outwardly, the valve head 76 is subjected to radially inwardly directed compression forces which tend to further resist opening of the slits 82. Further, the valve head 76 generally retains its closed configuration as it moves forward and even after the sleeve 78 and valve head 76 reach the fully extended position (approximately as shown in FIG. 15). However, when the internal pressure becomes sufficiently great compared to the external pressure, then the slits 82 in the extended valve head 76 quickly open to dispense product (FIGS. 16-19). The fluent material is then expelled or discharged through the open slits 82.

The above-discussed dispensing action of valve 22 typically would occur only after (1) a lid (if any) has been moved to an open position, (2) the package has been tipped or inverted, and (3) the container is squeezed. Pressure on the interior side of the valve 22 will cause the valve to open when the differential between the interior and exterior pressure reaches a predetermined amount. Preferably, the valve 22 is designed to open only after a sufficiently great pressure differential acts across the valve—as caused by squeezing the container with sufficient force (if the container is not a rigid container), and/or caused by a sufficiently reduced pressure (i.e., vacuum) applied to the exterior of the spout 50.

Depending on the particular valve design, the open valve 22 may close when the pressure differential decreases, or the valve may stay open even if the pressure differential decreases to zero. In the preferred embodiment of the valve 22 illustrated for the preferred embodiment of the system shown in FIGS. 1-9, the valve 22 is designed to close when the pressure differential decreases to, or below, a predetermined magnitude. Thus, when the squeezing pressure on the container is released, the valve 22 closes, and the valve head 76 retracts to its recessed, rest position within the spout 52.

Preferably, the valve 22 is designed to withstand the weight of the fluid on the inside of the valve 22 when the container is completely inverted. With such a design, if the container is inverted while the valve 22 is closed, but the container is not being squeezed, then the mere weight of the fluent material on the valve 22 does not cause the valve 22 to open, or to remain open. Further, if the container on which the closed valve 22 is mounted inadvertently tips over (after a lid, if any, is opened), then the product still does not flow out of the valve 22 because the valve 22 remains closed.

In one preferred embodiment, the valve petals 83 open outwardly only when the valve head 76 is subjected to a predetermined pressure differential acting in a pressure gradient direction wherein the pressure on the valve head interior surface exceeds—by a predetermined amount—the local ambient pressure on the valve head exterior surface. The product can then be dispensed through the open valve 22 until the pressure differential drops below a predetermined magnitude, and the petals 83 then close completely.

The valve 22 can also be designed to be flexible enough to accommodate in-venting of ambient atmosphere as described in detail below, so that the closing petals 83 can continue moving further inwardly to allow the valve 22 to open inwardly as the pressure differential gradient direction reverses, and the pressure on the valve head exterior surface 102 exceeds the pressure on the valve head interior surface 104 by a predetermined magnitude.

For some dispensing applications, it may be desirable for the valve 22 not only to dispense the product, but also to accommodate such in-venting of the ambient atmosphere (e.g., so as to allow a squeezed container (on which the valve is mounted) to return to its original shape). Such an in-venting capability can be provided by selecting an appropriate material for the valve construction, and by selecting appropriate thicknesses, shapes, and dimensions for various portions of the valve head 76 for the particular valve material and overall valve size. The shape, flexibility, and resilience of the valve head, and in particular, of the petals, can be designed or established so that the petals will deflect inwardly when subjected to a sufficient pressure differential that acts across the head 76 and in a gradient direction that is the reverse or opposite from the pressure differential gradient direction during product dispensing. Such a reverse pressure differential can be established when a user releases a squeezed, resilient container on which the valve 22 is mounted. The resiliency of the container wall (or walls) will cause the wall to return toward the normal, larger volume configuration. The volume increase of the container interior will cause a temporary, transient drop in the interior pressure. When the interior pressure drops sufficiently below the exterior ambient pressure, the pressure differential across the valve 22 will be large enough to deflect the valve petals inwardly to permit in-venting of the ambient atmosphere. In some cases, however, the desired rate or amount of in-venting may not occur until the squeezed container is returned to a substantially upright orientation that allows the product to flow under the influence of gravity away from the valve 22.

It is to be understood that the valve dispensing orifice may be defined by structures other than the illustrated slits 82. If the orifice is defined by slits, then the slits may assume other shapes, sizes and/or configurations in accordance with those dispensing characteristics desired. For example, the orifice may also include five or more slits.

The dispensing valve 22 is preferably configured for use in conjunction with a particular container, and a specific type of product, so as to achieve the exact dispensing characteristics desired. For example, the viscosity and density of the fluid product can be factors in designing the specific configuration of the valve 22 for liquids, as is the shape, size, and strength of the container. The rigidity and durometer of the valve material, and size and shape of the valve head 76, are also important in achieving the desired dispensing characteristics, and can be matched with both the container and the fluent substance to be dispensed therefrom.

It has been found that the novel configuration of the valve 22, especially of the valve head 76, provides improved performance with respect to accelerated, transient, hydraulic pressure effects or hydraulic hammer. If the package containing the closure with the valve is set or moved against a surface with a substantial force and impact, the valve resists opening from the transient pressure or hydraulic hammer forces. The increased resistance to valve opening when subjected to hydraulic hammer is significant in situations where much or most of the product or other fluid substance in the contained has been discharged, and the user slams or impacts the package against a surface to settle the remaining fluid product to one end of the container which tends to cause multiple impacts on the valve. Under such conditions, the novel valve of the present invention has less of a tendency to open and leak.

Further, when the valve is incorporated in a closure with a baffle plate, such as the baffle plate 122 provided in the retaining ring 34 as discussed above, the baffle plate will further enhance the ability of the valve to resist opening in response to hydraulic hammer pressures when the package is impacted, and the baffle plate arrangement is particularly effective in minimizing pre-mature opening leakage through the valve when the package is thrown onto a surface which could create vibrations in the closure and fluid substance or when the package is dropped at an angle causing a side impact on the package.

The resistance of the valve to pre-mature opening when the valve is subjected to internal hydraulic hammer transient pressure effects is believed to be, at least in part, the result of providing the valve head central portion with a axially inwardly projecting bulge and a somewhat thicker thickness at the center of the bulging portion where the slits intersect.

Further, the convex arcuate configuration (when viewed from the valve interior) of the valve in the closed condition is also believed to contribute to the improved characteristics of resisting internal hydraulic hammer transient pressure effects. Although there is no intent to be bound by any particular theory of operation, it is believed that the novel configuration provides for a more stable, as well as stiffer sealing configuration of the slits in the closed position.

It will be readily observed from the foregoing detailed description of the invention and from the illustrations thereof that numerous other variations and modifications may be effected without departing from the true spirit and scope of the novel concepts or principles of this invention.

What is claimed is:

1. A fluid dispensing valve having a generally circular configuration relative to a longitudinal axis along which a fluid substance can be dispensed from said valve in a discharge flow direction, said valve having an axially outward direction that is defined by said discharge flow direction, and said valve having an axially inward direction that is defined as the direction opposite to said axially outward direction, said valve comprising:

(A) a peripheral mounting portion;

(B) a valve head that is flexible and resilient, said valve head having (1) a normally closed orifice that is defined by at least one slit and that can open to permit a discharge flow of said substance, (2) a fully retracted, closed position that is axially inward of at least another part of said valve, (3) an exterior surface which (a) can interface with the environment on the valve exterior, and (b) has a generally recessed configuration as viewed from the valve exterior when said valve head is in the fully retracted, closed position, and (4) an interior surface which (a) can interface with a fluid substance on the valve interior, (b) has a radially outer surface portion with a convex arcuate configuration when viewed from the valve interior when said valve head is in the fully retracted, closed position, and (c) has a central inner surface portion that (i) is radially inside said radially outer surface portion, (ii) bulges axially inwardly to project from said radially outer surface portion, and (iii) has a convex arcuate configuration when viewed from the valve interior when the valve is in the fully retracted, closed position, and (5) a thickness between said exterior surface and said interior surface central inner surface portion that is thicker at the center on the longitudinal axis than the thickness of said head at the circumference of said interior surface central inner surface portion; and (C) a connector sleeve that (1) is flexible and resilient, (2) defines a generally tubular shape over at least part of the sleeve length, and (3) extends between, and connects, said peripheral mounting portion and said valve head in a configuration that, when said valve is subjected to a sufficient pressure differential, doubles over and extends rollingly in said axially outward direction as said valve head moves from said fully retracted, closed position to an extended position that is axially outward of said fully retracted, closed position and that accommodates opening of said orifice.

2. The fluid dispensing valve in accordance with claim 1 in which said valve head orifice is defined by a pair of intersecting slits, each said slit extending completely through the thickness of said valve head, and each said slit extending radially outwardly to at least said radially outer surface portion of said interior surface of said valve head.

3. The fluid dispensing valve in accordance with claim 1 in which said connector sleeve is defined at least in part by a generally tubular wall; and said tubular wall, as viewed in longitudinal cross section along a plane containing said longitudinal axis, has a generally J-shaped cross section when the valve is positioned so that said longitudinal axis is vertically oriented with said valve head up and with said peripheral mounting portion down.

4. The fluid dispensing valve in accordance with claim 1 in which said connector sleeve is defined by a generally tubular wall having a generally uniform cross section.

5. The fluid dispensing valve in accordance with claim 1 in which said valve head exterior surface lies on a partially spherical locus that defines a circular arc in longitudinal cross section as viewed along a plane containing said longitudinal axis.

6. The fluid dispensing valve in accordance with claim 1 in which said valve head interior surface radially outer surface portion is a partially spherical surface that defines a circular arc as viewed in longitudinal cross section along a plane containing said longitudinal axis.

7. The fluid dispensing valve in accordance with claim 1 in which said valve head interior surface central inner surface portion is a partially spherical surface defining a circular arc when viewed in transverse cross section along a plane containing said longitudinal axis.

8. The fluid dispensing valve in accordance with claim 7 in which said valve head interior surface central inner surface portion circular arc has a radius, and said valve head exterior surface lies on a partially spherical locus defining a circular arc having a radius that is slightly larger than the radius of said valve head interior surface central inner surface portion.

9. The fluid dispensing valve in accordance with claim 1 in which the outer diameter of said valve head interior surface central inner surface portion is between about 10% and about 66% of the outer diameter of said valve head interior surface radially outer surface portion.

10. The fluid dispensing valve in accordance with claim 1 in which said valve head interior surface central inner surface portion projects in the axially inward direction beyond the radially outermost edge of said valve head interior surface central inner surface portion by a distance which is between about 5% and about 25% of the outer diameter of said valve head interior surface central inner surface portion.

11. The fluid dispensing valve in accordance with claim 1 in which said valve head is thicker at the center along the longitudinal axis than at the circumference of said valve head interior surface central inner surface portion; and said valve head interior surface central inner surface portion bulges in the axially inward direction from its circumference by an amount that is between about 25% and about 75% of the thickness of said valve head at the center on the longitudinal axis.

12. The fluid dispensing valve in accordance with claim 1 further including its combination with a baffle plate disposed axially inwardly of, and spaced from, said valve head central inner surface portion.

13. The fluid dispensing valve in accordance with claim 12 in which said baffle plate is a unitary part of a retaining ring which can be used to hold said valve peripheral mounting portion in a closure.

14. The fluid dispensing valve in accordance with claim 12 in which said baffle plate has a frustoconical annular wall tapering to, and connected with, a generally flat, circular bottom wall.

15. The fluid dispensing valve in accordance with claim 12 in which flow apertures are defined around said baffle plate in said retaining ring for admitting flow of said fluid substance at the periphery of said valve head and at the interior side of said connector sleeve.

16. The fluid dispensing valve in accordance with claim 12 in which said orifice is defined by a plurality of intersecting slits which each extend laterally from the point of intersection of the slits to a radially outer end terminating in the valve head; and said baffle plate extends laterally beyond said radially outer end of each said slit.

17. The fluid dispensing valve in accordance with claim 12 in which the axial direction spacing between said valve head and said baffle plate is less than the diameter of said central inner surface portion of said valve head interior surface.

18. The fluid dispensing valve in accordance with claim 12 in which the axial direction spacing between said valve head and said baffle plate is less than the diameter of circular locus defined by the greatest radial extent of said slits from said intersection point of said slits at said longitudinal axis.

* * * * *